United States Patent [19]

Leppänen

[11] Patent Number: 4,732,509

[45] Date of Patent: Mar. 22, 1988

[54] METHOD AND A DEVICE FOR FEEDING CONCRETE INTO A DRILL HOLE IN THE CONCRETE BOILING OF A ROCK

[75] Inventor: Jarmo Leppänen, Ylöjärvi, Finland

[73] Assignee: Oy Tampella AB, Tampere, Finland

[21] Appl. No.: 921,144

[22] Filed: Oct. 21, 1986

[30] Foreign Application Priority Data

Nov. 7, 1985 [FI] Finland ..... 854378

[51] Int. Cl.[4] ..... E21D 20/02

[52] U.S. Cl. ..... 405/260; 405/269

[58] Field of Search ..... 405/240, 260, 269, 303, 405/259, 262

[56] References Cited

U.S. PATENT DOCUMENTS 4,116,368 9/1978 Smith ..... 405/260 X
4,514,111 4/1985 Issakainen ..... 405/260
4,643,619 2/1987 Issakainen ..... 405/303

FOREIGN PATENT DOCUMENTS 3005484 8/1980 Fed. Rep. of Germany .
79016168 2/1979 Sweden .
615245 1/1980 Switzerland .

*Primary Examiner*—David H. Corbin
*Attorney, Agent, or Firm*—Birch, Stewart, Kolasch & Birch

[57] ABSTRACT

A method of feeding concrete into a drill hole in the concrete bolting of a rock, in which method a feeding hose is pushed into the hole and concrete is pumped into the hole through the feeding hose at the same time as the hose is drawn outwards within the hole. In order to ensure that the hole is filled properly, the amount of concrete pumped into the feeding hose for the distance the feeding hose is withdrawn, is greater than the concrete amount theoretically sufficient for filling an unbroken hole with concrete when the hose is withdrawn that distance. A device designed for the realization of the method comprises a primary pump which pumps concrete into a piston-type metering pump which in turn pumps the metered amount of concrete into the feeding hose in proportion as the feeding hose is withdrawn.

10 Claims, 2 Drawing Figures

METHOD AND A DEVICE FOR FEEDING CONCRETE INTO A DRILL HOLE IN THE CONCRETE BOILING OF A ROCK

This invention relates to a method for feeding concrete into a drill hole in the concrete bolting of a rock, wherein a feeding hose is pushed into a hole, concrete is pumped into the hole through the feeding hose, and the feeding hose is drawn outwards within the hole in a synchronized manner with the pumping of concrete.

DESCRIPTION OF THE BACKGROUND ART

In rock bolting, bolts or wires are fastened by means of concrete within holes drilled in the rock for the reinforcement of the rock in mines and excavations.

Swedish Pat. Specification No. 7901616-8 discloses a rock bolting device in which a concrete feeding pipe is attached to a carriage which is displaceable along a supporting beam and by means of which the feeding pipe can be pushed into and withdrawn from a hole drilled in the rock.

Concrete is fed into the drill hole by means of this known device by pushing the feeding pipe up to the bottom of the hole and by feeding concrete into the hole simultaneously as the feeding pipe is drawn outwards within the hole. For the withdrawal of the feeding pipe, the operation of a displacing motor moving the carriage of the feeding pipe is positively synchronized with the operation of the motor of the concrete feeding pump so that at the same time as the feeding pipe moves outwards within the hole, concrete is fed into the hole through the feeding pipe in an amount which is estimated to be sufficient for filling the hole.

However, this way of feeding concrete is disadvantageous in that it does not reliably ensure that the drill hole really will be filled with the used amount of concrete. This is because there may be crushes and cracks in the rock, and the concrete may penetrate into these cracks and crushes when it is fed into the hole. Since the withdrawal of the feeding pipe is synchronized with the concrete feed, the result in such a case is that the hole is filled incompletely as the concrete mass intended for the hole penetrates into the crushes and cracks. On the other hand, it cannot be ascertained whether the crack has been filled, even incompletely, with the concrete mass. On account thereof, the placement of concrete about the rock bolt may be incomplete.

Swiss Pat. Specification No. 615,245 discloses a method for feeding concrete into a drill hole. This method is based on the idea that the concrete fed into the hole presses the feeding pipe outwards in the hole in proportion as the hole gets filled with concrete. However, the realization of this method requires that a flexible porous hose is pushed into the drill hole together with the feeding pipe so that the hose surrounds tightly the point portion of the feeding pipe, and the concrete flows within the hose. By means of this method, it is not possible to fill cracks and crushes, not even partially.

It has been suggested in Finnish Pat. Application No. 832,124 that the filling pressure of concrete in the drill hole should be utilized for positively drawing the feeding pipe out of the hole by means of a driving device, depending on the filling pressure of concrete prevailing in the hole at each particular moment. It is thereby ensured that not only the drill hole but also the cracks and crushes coming in the way of the hole can be filled with concrete. When the bolts are long, e.g. over 4 meters, the weight of the feeding pipe after it has been filled with concrete, the friction between the pipe and the hole, and the difference in the diameters of the pipe and the hole prevent the feeding pipe from acting as a piston for pushing the concrete. It is thereby necessary to adjust the withdrawing velocity of the feeding pipes so that it corresponds to the production rate of the pump, which implies uncertain factors.

SUMMARY OF THE INVENTION

The object of the present invention is to provide a method which avoids the above disadvantages and ensures that the drill hole is filled with concrete even if there are cracks and crushes in the rock. This object is achieved by means of a method according to the invention which is characterized in that the amount of concrete pumped into the feeding hose for the distance the feeding hose is withdrawn, is greater than the concrete amount which would fill an unbroken hole when the feeding hose is withdrawn said distance.

The invention is based on the idea that the concrete is pumped into the drill hole in a controlled manner in an excess of e.g. 20 percent as compared with the amount of concrete required for the filling of a hole without any cracks. If there are cracks in the rock, the excess concrete penetrates into the cracks. When the degree of breakage of the rock is known, the concrete excess can be adjusted according to the kind of the rock so as to ensure that the drill hole will be filled. The concrete excess penetrates into the cracks, and the cracks are filled only in the vicinity of the drill hole, which usually suffices for fastening the bolt within the hole.

The pumping of concrete can be controlled on the basis of the distance the feeding hose is withdrawn or on the basis of the withdrawing velocity, whereby the feeding of the concrete excess into the drill hole is carried out positively depending on the withdrawing movement of the feeding hose.

When a hole is drilled in a rock, the depth of the hole can be measured during the drilling so that the distance of the drill bit from the opening of the drill hole at each particular moment is known. When the drill bit penetrates into a major fracture in the rock, the driller becomes aware of the crack or the cavity on account of the movement of the drilling machine. The kind of the rock can be determined on the basis of the depth values of the cavities observed over the length of the drill hole.

By measuring the extent of the movement of the concrete feeding hose, the point of the feeding hose can be stopped at desired points within the drill hole. When the feeding hose is pushed into the hole, concrete can be pumped at the cavities before the hole is actually filled. When the feeding hose is withdrawn from the hole, the point of the feeding hose can be stopped at the cavities and these can be filled merely by pumping concrete. Minor fractures in the rock, which the driller perhaps has not noticed during the drilling, are filled automatically by the metered excess of concrete.

The invention is also concerned with a concrete feeding device intended for the realization of the method, which device comprises a feeding hose which can be pushed into the drill hole for feeding concrete into the hole, a primary pump for pumping concrete into the feeding hose, and a displacing mechanism for pushing the feeding hose into the hole and for drawing it out of the hole. The device is characterized in that it comprises a piston-type metering pump which is connected to the primary pump and the feeding hose for receiving a certain amount of concrete from the primary pump and for pumping it into the feeding hose, and that a driving device of the metering pump is connected to a measuring device sensing the withdrawing movement of the feeding hose for the control of the driving device of the metering pump on the basis of the withdrawing movement of the feeding hose or vice versa.

The primary pump of the device fills the piston-type secondary pump, which acts as a metering device, whereby the primary pump does not effect a pumping stroke for pushing concrete into the hole until the metering pump has been filled properly. The stroke of the metering pump is proportioned to the distance the feeding hose is withdrawn per one metered amount of concrete of the feeding pump. By virtue of the feeding pump, the amount of concrete pumped into the hole is accurately known. Because of the leakages and the pumping losses, conventional concrete pumps do not provide sufficiently reliable information of the actual amount of pumped concrete.

The stroke of the metering pump can be proportioned to the withdrawing movement of the hose by means of an electrohydraulic or a hydraulic tracking control. The stroke velocity of the metering pump can be controlled by sensing the withdrawing velocity of the feeding hose.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will be described in the following in more detail with reference to the attached drawings which are given by way of illustration only, and thus are not limitative of the present invention, and wherein.

DETAILED DESCRIPTION OF THE PREFERRED EMBODIMENTS

Figure 1:
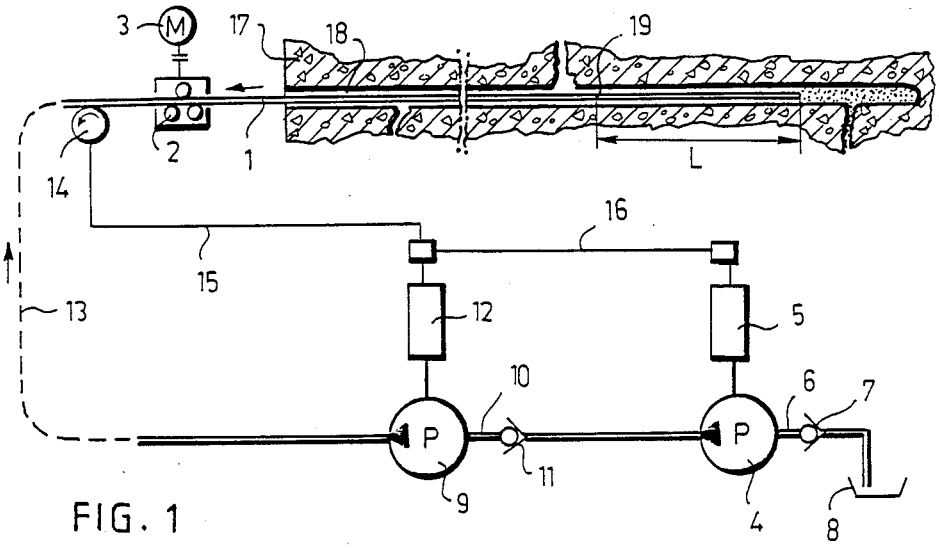
FIG. 1 illustrates schematically the operating principle of a concrete feeding device suited for the realization of the method.
Figure 2:
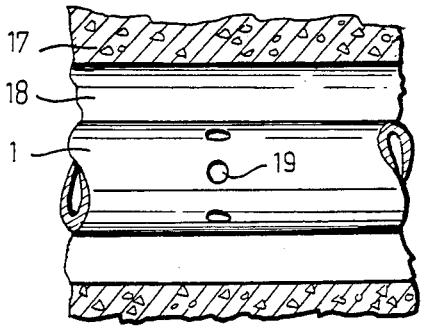
FIG. 2 is an enlarged axial section of a feeding hose positioned within a drill hole.

FIG. 1 of the drawing illustrates a feeding hose 1 of a concrete feeding device, which hose is supported on a boom system and a feeding beam mounted on a carrier (not shown), as is disclosed e. g. in the Applicant's Finnish Pat. Specification No. 832,124, which describes a rock bolting device.

The feeding hose goes through a displacing mechanism 2 by means of which the hose is axially displaceable. The displacing mechanism is operated by driving device 3, e.g. a hydraulic motor.

For the pumping of concrete the device comprises a primary pump 4 which can be of any type, preferably a single or double acting piston pump. The driving device 5 of the pump is preferably a hydraulic cylinder. The inlet side of the pump is connected by a conduit through a back valve 7 to a vessel 8 feeding concrete.

The concrete pumping means further comprise a single-acting piston-type metering pump 9 the inlet side of which is connected by a conduit 10 through a back valve 11 to the exhaust side of the primary pump. The driving device 12 of the metering pump is preferably a hydraulic cylinder. The exhaust side of the metering pump is connected to the feeding hose 1, as illustrated by the broken line 13.

A measuring device 14 is provided in the path of the feeding hose for the registration of the axial movements of the feeding hose. The measuring device is arranged to control the operation of the driving device of the metering pump, as shown by the connecting line 15. The control can be effected e.g. in such a manner that the pumping stroke of the metering pump proceeds a certain distance per a certain number of revolutions of the measuring roller of the measuring device. The object is to proportion the movement of the feeding hose to the pumping of the metering pump so that a certain axial travel of the feeding hose corresponds to a certain amount of concrete pumped by the metering pump. The control between the measuring device and the driving device of the metering pump can be based either on an electrohydraulic or a hydraulic tracking control.

The driving device 12 of the metering pump, in turn, is connected to control the driving device 5 of the primary pump, as shown by the connecting line 16, whereby the primary pump is started after the metering pump has completed the concrete pumping stroke, and it effects the return stroke of the piston of the metering pump and the filling of the metering pump with concrete. After the metering pump has completed the return stroke, the control stops the primary pump. The control between the measuring device and the metering pump initiates the pumping stroke of the metering pump when the feeding hose starts to move outwards within the drill hole.

The device operates in the following way.

The primary pump fills the metering pump with a certain metered amount of concrete. After the feeding hose has been pushed into a hole 18 drilled in a rock 17 by means of the displacing mechanism and the displacing mechanism has started to draw the feeding hose outwards within the hole, the roller of the measuring device starts to roll against the feeding hose and responds to the withdrawing movement thereof by giving a starting impulse to the driving device of the metering pump. The metering pump thereby effects a stroke which is proportioned to the withdrawing movement of the hose so that concrete is pressed into the hose from the pump and further into the hole in proportion as the hose moves outwards within the hole.

According to the invention the stroke of the metering pump, i.e. the metered amount of concrete pumped into the feeding hose, is proportioned to the withdrawing movement of the feeding hose in such a manner that the concrete amount pushed into the hole is excessive as compared with the amount which would be theoretically sufficient to fill the drill hole if the hole were whole, i.e. without any cracks or fissures. This excess can be e.g. 20 percent, and it can be made greater or smaller, depending on the characteristics of the rock in question. A rock having relatively many cracks requires a greater excess than a rock having relatively few cracks. The excess concrete penetrates into such cracks and fissures during the pumping.

When the holes to be bolted are long, it may be necessary to fill the metering pump several times, whereby the displacing mechanism of the feeding hose is stopped during the filling.

When the drill hole is filled with concrete, the movement of the feeding hose can be stopped at cavities observed in advance in order to pump concrete thereinto by means of the metering pump while the control between the measuring device and the driving device is switched off. Cavities can be filled similarly when the feeding hose is pushed into the hole.

Air may get into the pump when concrete is pumped with the primary pump. This air can be removed through one or more minor openings 19 provided in the feeding hose at a distance L from the point of the hose. During the pumping thereof, the concrete mass flows slowly out of the small opening(s) while the main flow is discharged at the end of the feeding hose. When an air bubble comes at the opening, it is easily discharged through the small opening, because of the pressure acting on it in the hose.

The distance L is dependent on the length of the holes to be drilled and the adjustable concrete excess. If the drill hole is unbroken, the concrete excess must not exceed the distance L after the drill hole has been filled. The hose openings must be positioned outside the concrete column fed over the whole length of the drill hole so that the air can be discharged into the open space.

The drawing and the description related thereto are only intended to illustrate the idea of the invention. In their details, the method and the device according to the invention may vary within the scope of the claims. Instead of controlling the travel or the velocity of the pumping stroke on the basis of the distance the feeding hose is withdrawn or the velocity of the hose, it is possible to control the withdrawing movement or the velocity of the hose on the basis of the travel of the pumping stroke or the velocity thereof.

What is claimed is:

1. A method for feeding concrete into a drill hole in the concrete bolting of a rock, comprising the steps of:

pushing a feeding hose into a hole;

pumping concrete into the hole through the feeding hose; and drawing the feeding hose outwards within the hole in a synchronized manner with the pumping of concrete, said drawing normally being at a predetermined, continuous speed, wherein the amount of concrete pumped into the feeding hose for the distance the feeding hose is withdrawn is greater than the concrete amount which would fill an unbroken hole when the feeding hose is withdrawn said distance.

2. A method according to claim 1, wherein the concrete amount is made the greater the more fractured the rock around the drill hole is.

3. A method according to claim 2, wherein the concrete amount is pumped in proportion to the withdrawing movement of the feeding hose.

4. A method according to claim 3, wherein the length of the pumping stroke of the concrete pump is controlled on the basis of the distance the feeding hose is withdrawn or vice versa.

5. A method according to claim 3, wherein the velocity of the pumping stroke of the concrete pump is controlled on the basis of the withdrawing velocity of the feeding hose or vice versa.

6. A method according to claim 1, wherein in the step of pushing the feeding hose into the drill hole, the point of the hose is stopped at cracks, cavities and the like observed during the drilling of the hole, and concrete is pumped into the feeding hose.

7. A method according to claim 1, wherein in the step of drawing the feeding hose out of the drill hole, the point of the hose is stopped at cracks, cavities and the like observed during the drilling, and the pumping of the concrete is continued.

8. A method according to claim 1, wherein the concrete is first pumped by means of a primary pump into a piston-type metering pump, the concrete is thereafter pumped by the pumping stroke of the metering pump into the feeding hose at the same time as the hose is drawn outwards within the drill hole, and the primary pump is stopped for the time of the pumping stroke of the metering pump.

9. A device for feeding concrete into a drill hole in the concrete bolting of a rock, comprising:

a feeding means which is pushed into said drill hole for feeding concrete into the hole;

a primary pump for pumping concrete into the feeding hose;

a displacing mechanism for pushing the feeding hose into the hole and for drawing it out therefrom, said displacing mechanism normally drawing said hose out of said hole at a predetermined, continuous speed;

a piston-type metering pump which is connected to the primary pump and the feeding hose for receiving a certain amount of concrete from the primary pump and for pumping it into the feeding hose; and a driving device of the metering pump being connected to a measuring device sensing the withdrawing movement of the feeding hose for the control of the driving device of the metering pump on the basis of the withdrawing movement of the feeding hose or vice versa.

10. A device according to claim 9, wherein the metering pump is adapted to pump into the feeding hose a concrete amount corresponding to one stroke thereof for a certain distance the feeding hose is withdrawn, said concrete amount being greater than the concrete amount which is required for filling an unbroken hole with concrete when the feeding hose is withdrawn said distance.

* * * * *